US009732945B2

(12) United States Patent
Friz

(10) Patent No.: US 9,732,945 B2
(45) Date of Patent: Aug. 15, 2017

(54) LAMPSHADE COVER

(71) Applicant: Katherine Friz, Delaware, OH (US)

(72) Inventor: Katherine Friz, Delaware, OH (US)

( * ) Notice: Subject to any disclaimer, the term of this patent is extended or adjusted under 35 U.S.C. 154(b) by 190 days.

(21) Appl. No.: 14/872,782

(22) Filed: Oct. 1, 2015

(65) Prior Publication Data

US 2017/0097145 A1 Apr. 6, 2017

(51) Int. Cl.
*F21V 17/10* (2006.01)
*F21V 1/14* (2006.01)
*F21V 1/16* (2006.01)

(52) U.S. Cl.
CPC ..... *F21V 17/105* (2013.01); *F21V 1/143* (2013.01); *F21V 1/16* (2013.01)

(58) Field of Classification Search
CPC ..... F21V 17/105; F21V 1/16; F21V 1/143
See application file for complete search history.

(56) References Cited

U.S. PATENT DOCUMENTS 2,111,844 A 3/1938 Davidson
3,016,952 A * 1/1962 Shero ..... B60J 1/2011 160/105
4,731,715 A 3/1988 Anderson
5,311,415 A 5/1994 Hyland
5,532,912 A 7/1996 Bendit
5,662,412 A 9/1997 Glendmyer
D657,903 S 4/2012 MacVeigh
8,596,833 B1 12/2013 Cytrynowicz
8,668,367 B2 3/2014 Anderson et al.
D710,531 S 8/2014 MacVeigh
8,992,054 B1 3/2015 Grollmus
2009/0196051 A1 8/2009 Dick et al.
2013/0155692 A1* 6/2013 Federici ..... F21V 1/02 362/353

* cited by examiner

*Primary Examiner* — David V Bruce
(74) *Attorney, Agent, or Firm* — Porter, Wright, Morris & Arthur, LLP

(57) ABSTRACT

A removable cover for a lampshade having a support frame of a ferromagnetic material. The cover includes a rectangular-shaped sheet of material having top, bottom, first side, and second side edges cooperating to form an inner surface and an outer surface configured to cover the lampshade, and first, second, third, and fourth pluralities of magnets. The first plurality of magnets is at the inner surface and is spaced-apart along the top edge. The second plurality of magnets is at the inner surface and is spaced-apart along the bottom edge. The third plurality of magnets is at the inner surface and is spaced-apart along the first side edge. The fourth plurality of magnets is at the inner surface and is spaced-apart along the second side edge. The pluralities of magnets are configured to be removably secured to the support frame to removably secure the cover to the lampshade.

18 Claims, 5 Drawing Sheets

LAMPSHADE COVER

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to lighting fixtures such as floor and tabletop lamps and, more particularly, to lampshades and lampshade covers for such lighting fixtures.

BACKGROUND OF THE INVENTION

A lamp typically has a light source such as an incandescent, halogen, fluorescent, or LED bulb. A lamp also typically has a lampshade positioned about the light source to diffuse light produced from the light source. The lampshade also can serve as a decorative element within a room. As a result, lampshades can be manufactured from a wide variety of materials and can have a wide variety of shapes and sizes. Some materials such as, for example, rice paper provide an appealing aesthetic but are relatively fragile and difficult to clean. Because such lampshades can be relatively expensive, it is desirable to keep them from getting dirty to minimize cleaning which can result in damage and to protect them from other damage.

Covers for lampshades are well known. However, such known covers for lampshades are less than desirable. Such known covers lampshades typically are ill-fitting insofar as they do not closely conform to or form fit the original existing lampshade. These covers for lampshades typically require tucks, puckers, pleats, draw strings, folds, overlaps, and/or multiple seams in order to cover the lampshade. Additionally, many of these known covers for lampshades overhang the top and or the bottom of the lampshade. All of which results in an undesirable aesthetic appearance. Furthermore, many of these known covers for lampshades are permanently attached to the lampshades or are attached to the lampshades in a manner that impacts the aesthetic appearance of the lampshades if the covers are removed. The lampshades often require alterations to incorporate attachment means for the covers such as, for example, slits, slots, hook-and-loop fasteners, snaps, straps, and other attachments on the lampshades.

Accordingly, there is a need for improved removable covers for lampshades that can be installed onto lampshades to cover and protect the lampshades without altering the lampshades.

SUMMARY OF THE INVENTION

Disclosed are lampshade covers that overcome at least one of the disadvantages of the prior art described above.

Disclosed is a removable cover for a lampshade having a support frame of a ferromagnetic material, said removable cover comprising, in combination, a rectangular-shaped sheet of material having a top edge, a bottom edge, a first side edge, a second side edge cooperating to form an inner surface and an outer surface configured to cover the lampshade, and first, second, third, and fourth pluralities of magnets. The first plurality of magnets is at the inner surface of the sheet of material and is spaced-apart along the top edge of the sheet of material. The second plurality of magnets is at the inner surface of the sheet of material and is spaced-apart along the bottom edge of the sheet of material. The third plurality of magnets is at the inner surface of the sheet of material and is spaced-apart along the first side edge of the sheet of material. The fourth plurality of magnets is at the inner surface of the sheet of material and is spaced-apart along the second side edge of the sheet of material. The first, second, third, and fourth pluralities of magnets are configured to be removably secured to the support frame to secure the cover to the lampshade.

Also disclosed is a lamp shade with removable cover comprising, in combination, a lampshade having material covering a support frame of ferromagnetic material, and a removable cover. The removable cover comprises a rectangular-shaped sheet of material covering an outer surface of the material of the lampshade and having a top edge, a bottom edge, a first side edge, a second side edge forming an inner surface and an outer surface configured to cover the lampshade, and first, second, third and fourth pluralities of magnets. The first plurality of magnets is at the inner surface of the sheet of material and is spaced-apart along the top edge of the sheet of material. The first plurality of magnets is magnetically secured to the support frame. The second plurality of magnets is at the inner surface of the sheet of material and is spaced-apart along the bottom edge of the sheet of material. The second plurality of magnets is magnetically secured to the support frame. The third plurality of magnets is at the inner surface of the sheet of material and spaced-apart along the first side edge of the sheet of material. The third plurality of magnets is magnetically secured to the support frame. The fourth plurality of magnets is at the inner surface of the sheet of material and is spaced-apart along the second side edge of the sheet of material. The fourth plurality of magnets is magnetically secured to the support frame.

Also disclosed is a lamp comprising, in combination, a base, a socket for receiving an electric light bulb supported by the base, a lampshade supported by the base and extending about the socket, and a removable cover. The lampshade includes material covering a support frame of ferromagnetic material. The removable cover comprises a rectangular-shaped sheet of material covering an outer surface of the material of the lampshade and having a top edge, a bottom edge, a first side edge, a second side edge forming an inner surface and an outer surface configured to cover the lampshade, and first, second, third and fourth pluralities of magnets. The first plurality of magnets is at the inner surface of the sheet of material and is spaced-apart along the top edge of the sheet of material. The first plurality of magnets is magnetically secured to the support frame. The second plurality of magnets is at the inner surface of the sheet of material and is spaced-apart along the bottom edge of the sheet of material. The second plurality of magnets is magnetically secured to the support frame. The third plurality of magnets is at the inner surface of the sheet of material and spaced-apart along the first side edge of the sheet of material. The third plurality of magnets is magnetically secured to the support frame. The fourth plurality of magnets is at the inner surface of the sheet of material and is spaced-apart along the second side edge of the sheet of material. The fourth plurality of magnets is magnetically secured to the support frame.

From the foregoing disclosure and the following more detailed description of various preferred embodiments it will be apparent to those skilled in the art that the present invention provides a significant advance in the technology and art of lampshade covers. Particularly significant in this regard is the potential the invention affords for a device that is relatively inexpensive and effectively covers lampshades and can be easily changed installed and removed without alteration or damage to the lampshade. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
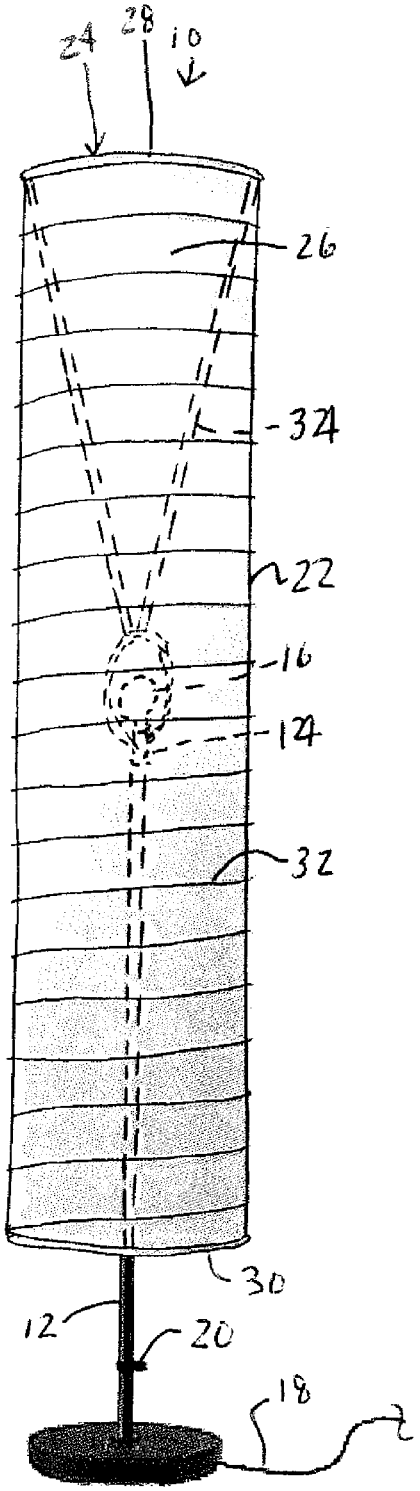
FIG. 1 is a perspective view of a lamp with a lampshade.

It should be understood that the appended drawings are not necessarily to scale, presenting a somewhat simplified representation of various preferred features illustrative of the basic principles of the invention. The specific design features of the vibration isolation systems as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the vibration isolation systems illustrated in the drawings. In general, up or upward refers to an upward direction generally within the plane of the paper in FIG. 2 and down or downward refers to a downward direction generally within the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved lampshade covers disclosed herein. The following detailed discussion of various alternative and preferred embodiments will illustrate the general principles of the invention with regard to the specific application of a floor lamp. Other embodiments suitable for other applications will be apparent to those skilled in the art given the benefit of this disclosure such as, for example, table lamps and the like.

Referring now to the drawings, FIG. 1 shows lamp 10 having a base 12 configured to be supported on a horizontal support surface such as a floor. While the illustrated lamp 10 is configured as a floor lamp, it is noted that the lamp 10 can alternatively be configured as any other suitable type of lamp such as a table lamp and the like. The illustrated lamp 10 includes at least one socket 14 for receiving a light source 16 such as an electric light bulb secured to and supported by the base 12. The socket 14 can be configured to receive any suitable kind of light source 16 such as the electric light bulb. The electric bulb can be, for example, an incandescent, halogen, fluorescent, LED bulb, and the like. An electric cable or cord 18 extends from the socket 14 and is provided with a pronged plug adapted to be inserted into a standard wall electric outlet. An electric on-off switch 20 is provided on the base 12 and along the illustrated cord 18 to selectively open and close the flow of electricity from the wall outlet to the socket 14. It is noted that the electric circuit can alternatively have any other suitable configuration.

A lampshade 22 extends about the socket 14 and the light source 16 therein and is supported by the base 12. The illustrated lampshade 22 includes a support frame 24 of ferromagnetic material and a sheet of material 26 covering the sides of the support frame 24. The illustrated lamp shade 22 is cylindrical shaped with an open top and an open bottom but it is noted that the lampshade 22 can alternatively have any other suitable shape. The illustrated support frame 24 has a circular upper ring 28, a circular lower ring 30 spaced below the upper ring 28, and an intermediate support 32 in the form of a spiral wire extending between and connecting the upper and lower rings 28, 30. The support frame 24 also includes at least one connecting member 34 for connecting the support frame 24 to the lamp base 12 so that the lamp base 12 supports the support frame 24. It is noted that the support frame 24 can alternatively have any other suitable configuration. The sheet of material 26 is secured to and covering the side of the support frame 24 between the upper and lower rings 28, 30 with an inner surface toward the light source 16 and an out surface facing away from the light source 16. The illustrated sheet of material 26 covering the support frame is rice paper but it is noted that it can alternatively be any other suitable material for diffusing the light produced by the light source 16 such as, for example, other paper, polymer, fabric, and the like or a combination thereof.

Figure 2:
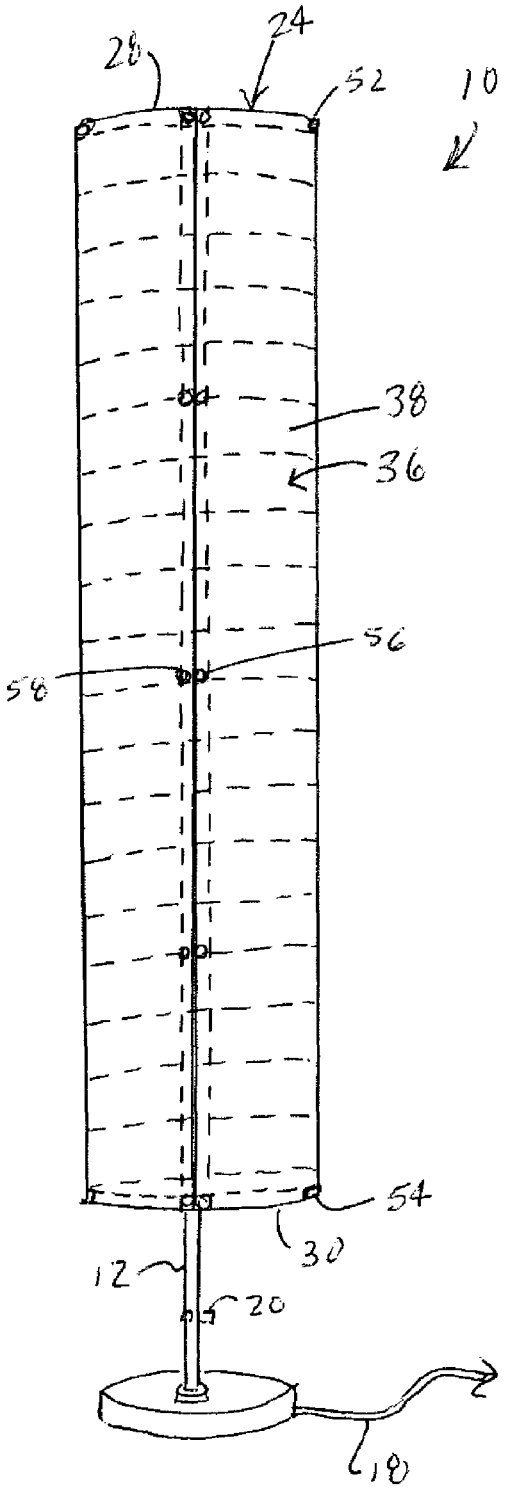
FIG. 2 is a perspective view of the lamp of FIG. 1 with a lampshade cover secured thereto according to the present invention.

FIG. 2 shows the lamp 10 with a removable cover 36 covering the lampshade 22 according to the present invention. The illustrated removable cover 36 includes a rectangular-shaped sheet of material 38 covering an outer surface of the sheet of material 26 of the lampshade 22 and having a top edge 40, a bottom edge 42, a first side edge 44, a second side edge 46 forming an inner surface 48 and an outer surface 50 configured to cover the lampshade 22, and first, second, third, and fourth pluralities of magnets 52, 54, 56, 58. The first plurality of magnets 52 is at the inner surface 48 of the sheet of material 38 and is spaced-apart along the top edge 40 of the sheet of material 38. The second plurality of magnets 54 is at the inner surface 48 of the sheet of material 38 and is spaced-apart along the bottom edge 42 of the sheet of material 38. The third plurality of magnets 56 is at the inner surface 48 of the sheet of material 38 and is spaced-apart along the first side edge 44 of the sheet of material 38. The fourth plurality of magnets 58 is at the inner surface 48 of the sheet of material 38 and is spaced-apart along the second side edge 46 of the sheet of material 38. The pluralities of magnets 52, 54, 56, 58 are removably secured to the support frame 24 to removably secure the cover 36 to the lampshade 22.

Figure 3:
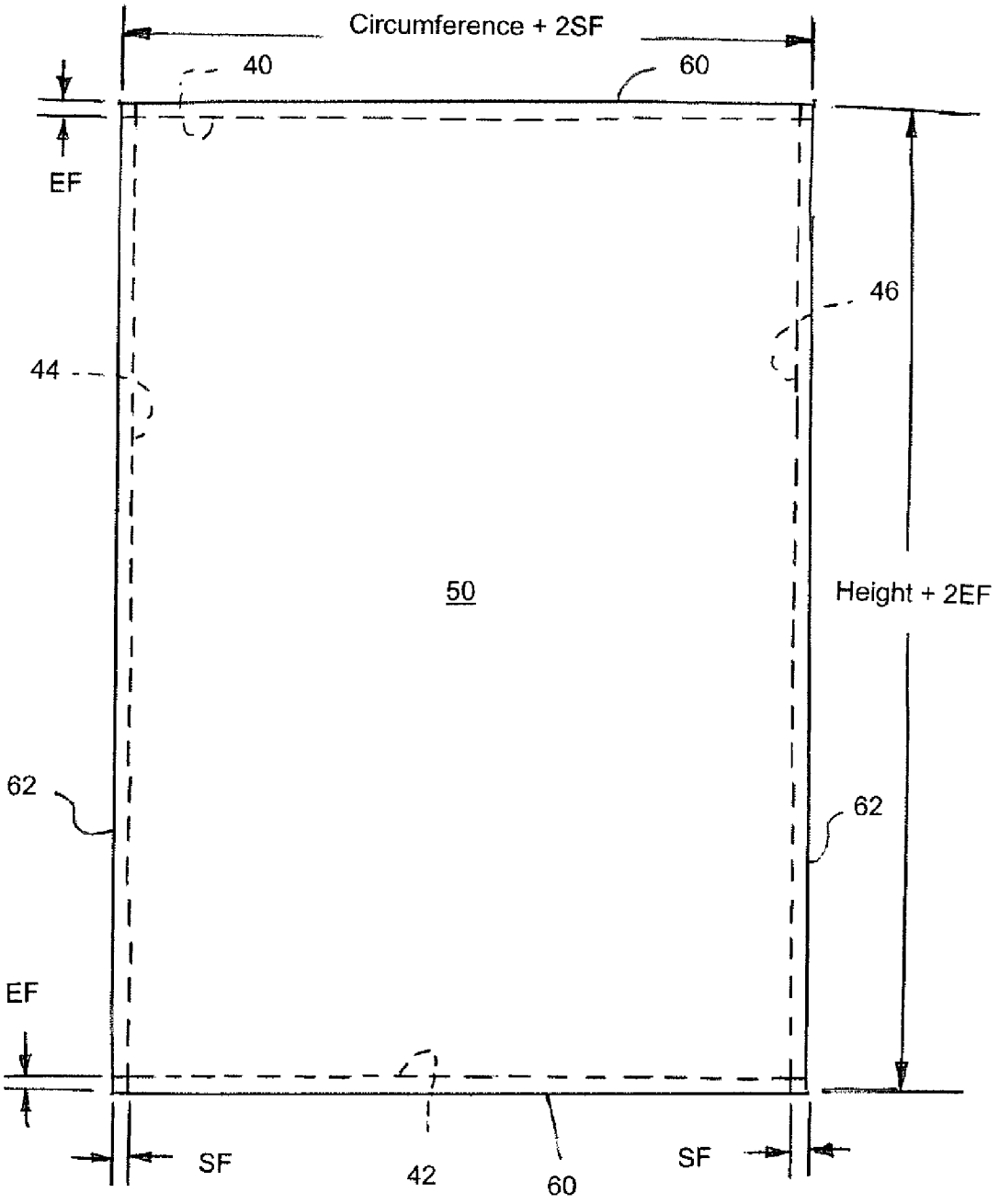
FIG. 3 is front view of a flat pattern for the lampshade cover of FIG. 1, wherein the dashed lines indicate fold lines during manufacture of the lampshade cover.

FIG. 3 shows a flat pattern for the sheet of material 38 for the lampshade cover 36. The illustrated flat pattern is rectangular-shaped having a total height (Height+2EF) greater than its width (Circumference+2SF). The total height (Height+2EF) is determined by adding the height of the lampshade (Height) and twice a predetermined end fold width (2EF) to account for a fold to be made at each end. The predetermined end fold width (EF) can be any suitable distance such as, for example, about 1 inch. The total width (Circumference+2SF) is determined by adding the circumference of the lampshade (Circumference) and twice a predetermined side fold width (2SF) to account for a fold to be made at each side. The predetermined side fold width (SF) can be any suitable distance such as, for example, about 1 inch. The width of the fold should be suitable for the size of the magnets 52, 54, 56, 58 being utilized as described in more detail hereinafter The material of the sheet of material 38 can be any suitable material that will protect the material 26 of the lampshade 22 and/or provide a desired aesthetic appearance. The material 38 can be a woven or non-woven fabric, a polymeric sheet, a paper sheet, and the like and combinations thereof.

Figure 4:
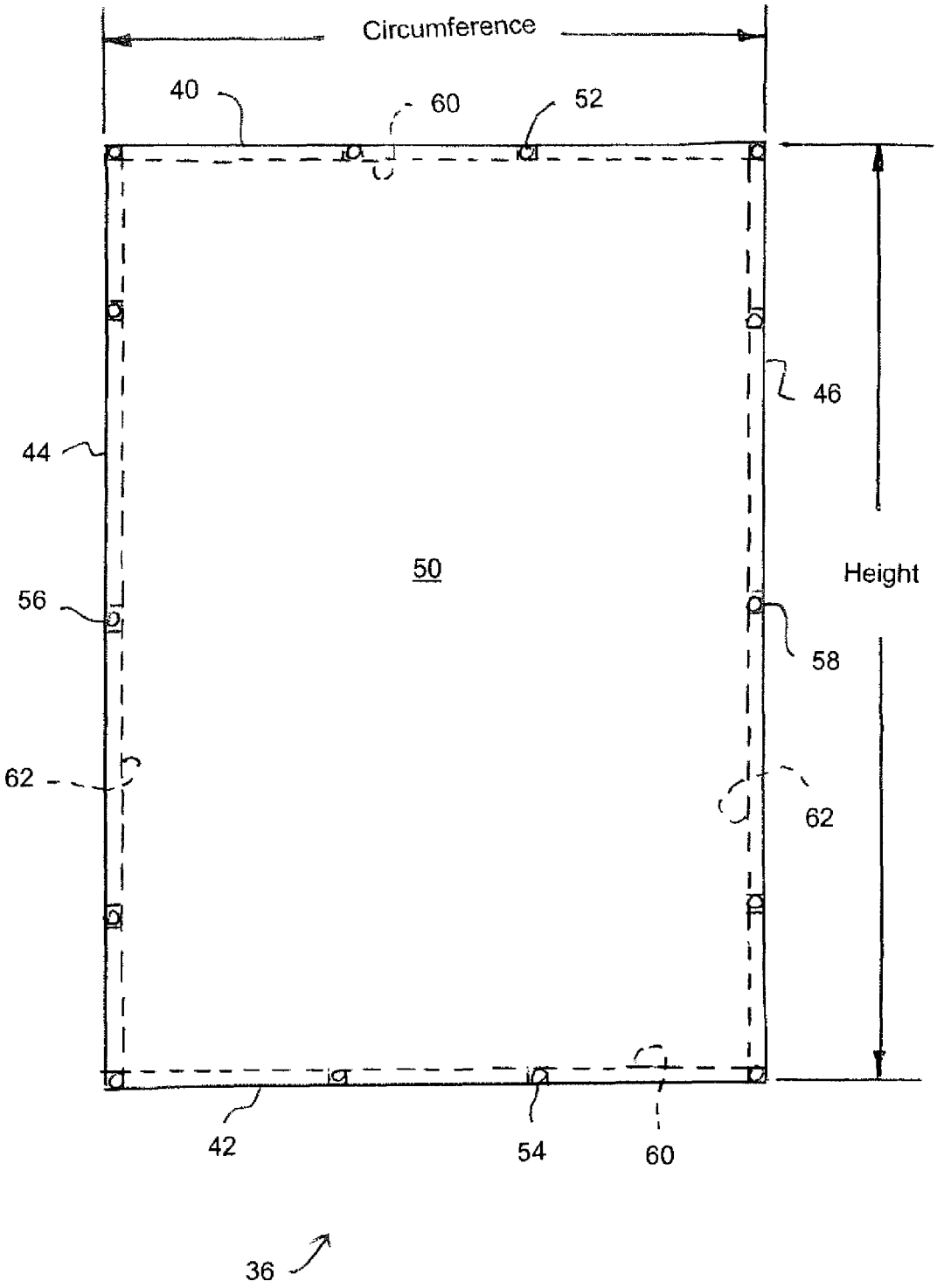
FIG. 4 is a front view of the lampshade cover of FIG. 2, wherein the lampshade cover has been removed from the lamp.
Figure 5:
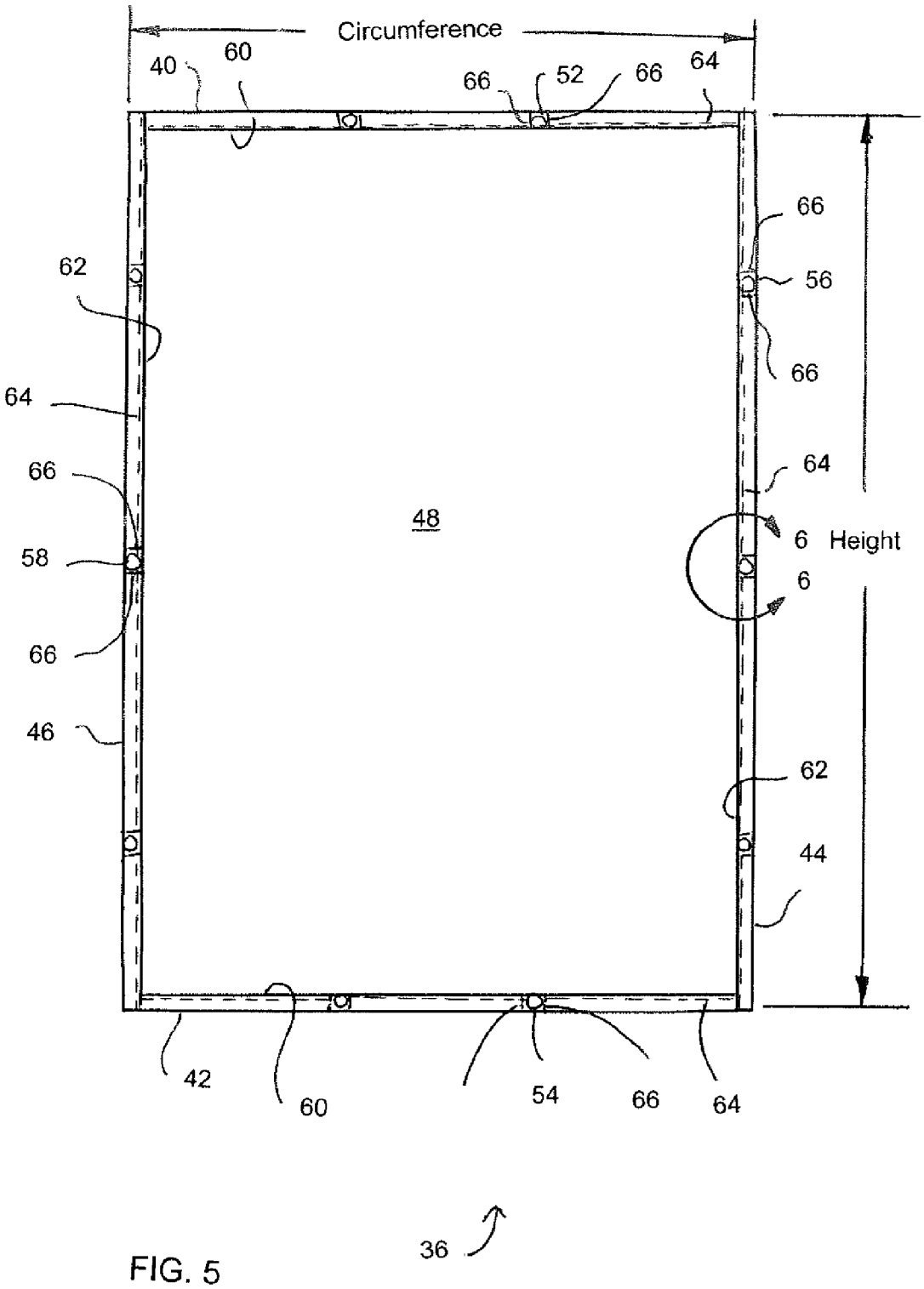
FIG. 5 is a rear view of the lampshade cover of FIG. 4.
Figure 6:
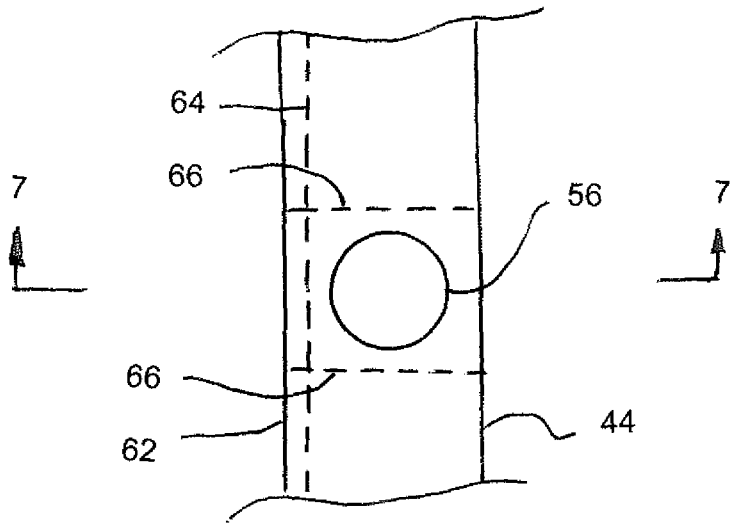
FIG. 6 is an enlarged, fragmented view of a portion of the lampshade cover taken at line 6-6 of FIG. 5.
Figure 7:
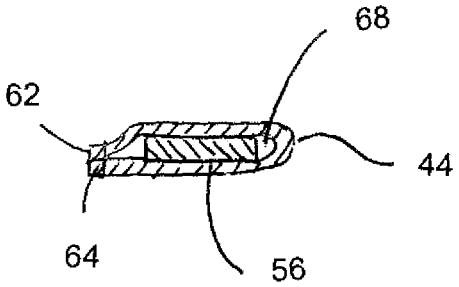
FIG. 7 is a cross-sectional view taken along line 7-7 of FIG. 6.

FIGS. 4 to 6 show the illustrated lampshade cover 36 after construction from the flat pattern shown in FIG. 3. The end folds (EF) 60 and the side folds (SF) 62 have been folded over and secured in place with first and second seams 64, 66 formed by thread, thermal adhesive, or the like such that there is a fold forming the top edge, the bottom edge, the right side edge, and the left side edge. Each illustrated fold (EF, SF) 60, 62 has a first seam 64 extending along its length near the edge of the flat pattern and opposite the folded edge and a plurality of second seams 66 extending across the width of the folds 60, 62 and perpendicular to the folded edge. The second seams 66 are positioned at least at the locations of the magnets 52, 54, 56, 58 with a pair of the second seams 66 spaced-apart on opposite sides of each magnet 52, 54, 56, 58 to form a hollow pocket 68 for holding and positioning the magnets 52, 54, 56, 58 at desired locations. It is noted that, the magnets 52, 54, 56, 58 are inserted into the pockets 68 prior to completing the seams 64,66 so that the magnets 52, 54, 56, 58 are retained within the closed-sided hollow pockets. The illustrated cover 36 includes five magnets 56, 58 along each side edge 44, 46 that are substantially equally spaced-apart but any other suitable quantity and spacing can alternatively be utilized. The illustrated cover 36 also has two additional magnets 52, 54 along each end edge 40, 42 that are substantially equally spaced-apart but any other suitable quantity and spacing can alternatively be utilized. It is noted that any other suitable configuration for the magnets 52, 54, 56, 58 can alternatively be utilized.

The magnets 52, 54, 56, 58 can be of any suitable type and size which can be easily secured to and removed from the support frame 24 of the lampshade 22. The magnets 52, 54, 56, 58 should collectively have enough holding force to secure the cover 36 to the lampshade 22 as desired. For heavier fabrics, more magnets or magnets with more holding power may be required. The magnets 52, 54, 56, 58 are preferably small but with a relatively high Gauss Rating. Suitable magnets 52, 54, 56, 58 for most applications are 8 mm in size with a Gauss Rating of 2870.

To install the cover 36 onto the lampshade 22, the cover 36 is wrapped around the lampshade 22 so that the magnets 52 along the top edge 40 of the cover 36 are secured to the top ring 28 of the lampshade 22, the magnets 54 along the bottom edge 42 of the cover 36 are secured to the bottom ring 30 of the lampshade 22, the magnets 56, 58 along the side edges 44, 46 of the cover 36 are secured to the intermediate support 32 of the lamp shade 22 so that the side edges 44, 46 of the cover 36 closely abut one another and the cover 36 is closely fitted to the outer surface of the lampshade 22. Installed in this manner, the cover 36 completely covers the exterior surface of the lampshade 22 to provide protection and/or a different aesthetic appearance. It is noted that the magnets 52, 54, 56, 58 entirely support the cover 36 on the lampshade 22 and alterations are not made to the lampshade 22. It is noted that alternatively the width of cover 36 can be sized larger so that the side edges 44, 46 overlap and the magnets 56, 58 along the side edges 44, 46 can be secured together rather than or in addition to being secured to the frame 24 of the lampshade 22. In this alternative embodiment, the total width of the flat pattern is Circumference+2SF+OL. The length of the overlap (OL) can be any suitable length such as, for example, about 1 inch.

To remove the cover 36 from the lampshade 22, the cover 36 is unwrapped around the lampshade 22 so that the magnets 52 along the top edge 40 of the cover 36 are removed from the top ring 30 of the lampshade 22, the magnets 54 along the bottom edge 42 of the cover 36 are removed from the bottom ring 30 of the lampshade 22, the magnets 56, 58 along the side edges 44, 46 of the cover 36 are removed from the intermediate support 32 of the lampshade 22 so that the cover 36 is no longer secured from the lampshade 22. Removed in this manner, the lampshade 22 is now in its original condition.

Any of the features or attributes of the above the above described embodiments and variations can be used in combination with any of the other features and attributes of the above described embodiments and variations as desired.

It is apparent from the above detailed description of preferred embodiments of the present invention, that any quantity of covers having different protective qualities and/or different aesthetic appearances can be interchangeably used to over the lampshade depending on the desired protection and/or aesthetic appearance, if any, desired at any given time.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A removable cover for a lampshade having a support frame of a ferromagnetic material, said removable cover comprising, in combination:

a rectangular-shaped sheet of material having a top edge, a bottom edge, a first side edge, a second side edge forming an inner surface and an outer surface configured to cover the lampshade;

a first plurality of magnets at the inner surface of the sheet of material and spaced-apart along the top edge of the sheet of material;

a second plurality of magnets at the inner surface of the sheet of material and spaced apart along the bottom edge of the sheet of material;

a third plurality of magnets at the inner surface of the sheet of material and spaced-apart along the first side edge of the sheet of material; and a fourth plurality of magnets at the inner surface of the sheet of material and spaced apart along the second side edge of the sheet of material;

wherein the first, second, third, and fourth plurality of magnets are configured to be removably secure to the support frame to secure the cover to the lampshade; and wherein the sheet of material is fabric and comprises pockets and each of the magnets are located within the pockets to secure the magnets to the sheet of material.

2. The removable cover according to claim 1, wherein the pockets are partially formed by folds along the edges of the sheet of material.

3. The removable cover according to claim 2, wherein the pockets are partially formed by threaded seams in the sheet of material.

4. The removable cover according to claim 1, wherein the sheet of material is configured so that the first and second edges closely abut when the cover extends about the lampshade.

5. A lamp shade with removable cover comprising, in combination:

a lampshade having material covering a support frame of ferromagnetic material; and a removable cover comprising:

a rectangular-shaped sheet of material covering an outer surface of the material of the lampshade and having a top edge, a bottom edge, a first side edge, a second side edge forming an inner surface and an outer surface configured to cover the lampshade;

a first plurality of magnets at the inner surface of the sheet of material and spaced-apart along the top edge of the sheet of material, wherein the first plurality of magnets is magnetically secured to the support frame;

a second plurality of magnets at the inner surface of the sheet of material and spaced-apart along the bottom edge of the sheet of material, wherein the second plurality of magnets is magnetically secured to the support frame;

a third plurality of magnets at the inner surface of the sheet of material and spaced-apart along the first side edge of the sheet of material, wherein the third plurality of magnets is magnetically secured to the support frame; and a fourth plurality of magnets at the inner surface of the sheet of material and spaced-apart along the second side edge of the sheet of material, wherein the fourth plurality of magnets is magnetically secured to the support frame.

6. The lamp shade with removable cover according to claim 5, wherein the sheet of material is fabric.

7. The lamp shade with removable cover according to claim 5, wherein the sheet of material is fabric comprises pockets and each of the magnets are located within the pockets to secure the magnets to the sheet of material.

8. The lamp shade with removable cover according to claim 7, wherein the pockets are partially formed by folds along the edges of the sheet of material.

9. The lamp shade with removable cover according to claim 8, wherein the pockets are partially formed by threaded seams in the sheet of material.

10. The lamp shade with removable cover according to claim 5, wherein the sheet of material is configured so that the first and second edges closely abut when the cover extends about the lampshade.

11. The lamp shade with removable cover according to claim 5, wherein the cover is secured to the lampshade only by the magnets.

12. A lamp comprising, in combination:

a base;

a socket for receiving an electric light bulb supported by the base;

a lampshade supported by the base and extending about the socket, wherein the lampshade includes material covering a support frame of ferromagnetic material; and a removable cover comprising:

a rectangular-shaped sheet of material covering an outer surface of the material of the lampshade and having a top edge, a bottom edge, a first side edge, a second side edge forming an inner surface and an outer surface configured to cover the lampshade;

a first plurality of magnets at the inner surface of the sheet of material and spaced-apart along the top edge of the sheet of material, wherein the first plurality of magnets is magnetically secured to the support frame;

a second plurality of magnets at the inner surface of the sheet of material and spaced-apart along the bottom edge of the sheet of material, wherein the second plurality of magnets is magnetically secured to the support frame;

a third plurality of magnets at the inner surface of the sheet of material and spaced-apart along the first side edge of the sheet of material, wherein the third plurality of magnets is magnetically secured to the support frame; and a fourth plurality of magnets at the inner surface of the sheet of material and spaced-apart along the second side edge of the sheet of material, wherein the fourth plurality of magnets is magnetically secured to the support frame.

13. The lamp according to claim 12, wherein the sheet of material is fabric.

14. The lamp according to claim 12, wherein the sheet of material is fabric comprises pockets and each of the magnets are located within the pockets to secure the magnets to the sheet of material.

15. The lamp according to claim 14, wherein the pockets are partially formed by folds along the edges of the sheet of material.

16. The lamp according to claim 15, wherein the pockets are partially formed by threaded seams in the sheet of material.

17. The lamp according to claim 12, wherein the sheet of material is configured so that the first and second edges closely abut when the cover extends about the lampshade.

18. The lamp according to claim 12, wherein the cover is secured to the lampshade only by the magnets.

* * * * *